United States Patent [19]

Borg et al.

[11] 4,305,237

[45] Dec. 15, 1981

[54] COMPACT SECTIONALIZED DRILLING MAST, POWER ARRANGEMENT AND SUPPORT MEANS THEREFOR

[75] Inventors: Paul E. Borg; John S. Eaton; David M. Limbert, all of Houston, Tex.

[73] Assignee: PRE Corporation, Houston, Tex.

[21] Appl. No.: 159,142

[22] Filed: Jun. 13, 1980

[51] Int. Cl.[3] ..... E04H 12/34; E21B 15/00

[52] U.S. Cl. ..... 52/116; 52/143; 173/151

[58] Field of Search ..... 52/116, 117, 118, 143; 173/151

[56] References Cited

U.S. PATENT DOCUMENTS

| | | | |
|---|---|---|---|
| 2,922,501 | 1/1960 | Wilson | 52/118 |
| 3,747,695 | 7/1973 | Branham | 52/116 X |
| 3,922,825 | 12/1975 | Eddy et al. | 52/116 |
| 4,024,924 | 5/1977 | Houck | 52/116 X |
| 4,138,805 | 2/1979 | Patterson | 52/116 X |
| 4,201,022 | 5/1980 | Jennings | 52/116 X |

*Primary Examiner*—Alfred C. Perham
*Attorney, Agent, or Firm*—Jack W. Hayden

[57] ABSTRACT

A sectionalized drilling mast, power arrangement and support means therefor includes base means to support the drilling mast means when reclined and when erect. Drawworks trailer ramp means are secured substantially at right angles to said base means; power source trailer ramp means secured to said drawworks trailer ramp means and extending parallel thereto; first trailer means on said drawworks trailer ramp means with drawworks support means pivotally connected thereto and drawworks means supported thereon; second trailer means on said power source trailer ramp means with power source support means pivotally connected thereto and power source means supported thereon; drilling mast means pivotally connected to the base beam means and extending therealong in vertical spaced relation thereto when in reclined position; setback tower means pivotally connected at one end to the mast and at the other end to the base beam means with a rotary table secured to the setback tower adjacent the mast and extending longitudinally therefrom. Means are provided to elevate the drawworks support means and drawworks, power source support means and power means thereon and the drilling mast respectively from a reclined to an upright position whereupon the setback tower means and rotary table connected therewith is simultaneously elevated and swung into position relative to the erected drilling mast.

4 Claims, 11 Drawing Figures

COMPACT SECTIONALIZED DRILLING MAST, POWER ARRANGEMENT AND SUPPORT MEANS THEREFOR

STATEMENT OF THE INVENTION

Many versions of trailerized drilling masts are known and are in use. However, they are generally limited in size to smaller, shallow drilling and workover rigs. These drilling rigs sometimes consist of one trailer carrying both the mast and the drawworks and power source, plus a small, separately handled substructure.

Somewhat larger drilling rigs consist of one trailer carrying the drawworks and power source with an additional dolly carrying the bottom end of the mast with the crown end of the mast carried on the fifth wheel of the towing truck-tractor. These drilling rigs and auxiliary equipment are designed to be transported over U.S. highways and roads as legal loads or as permit loads.

However, large drilling rigs of the size contemplated by the present invention have in the past been disassembled into the various components for transporting over U.S. highways and roads via utility floats and truck-tractors. Several loads are hauled in this manner to move the drilling rig and auxiliary equipment. This is time consuming and costly, not only in the hauling but in the rig-down and rig-up procedures.

A primary object of the present invention is to reduce to a minimum the number of pieces to be disassembled and reassembled and the number of loads to be transported where a large drilling rig and its auxiliary equipment are involved. All loads will be legal weight per axle, but some loads will be oversize and require permit or escort due to the width of the load and possible length or height. Nevertheless, substantial time will be saved in the move from one location to another.

BRIEF DESCRIPTION OF THE DRAWING

FIG. 7A also illustrates the middle section of the mast connected to the lower section and extending longitudinally therefrom;

BRIEF DESCRIPTION OF THE PREFERRED EMBODIMENT

Figure 8:
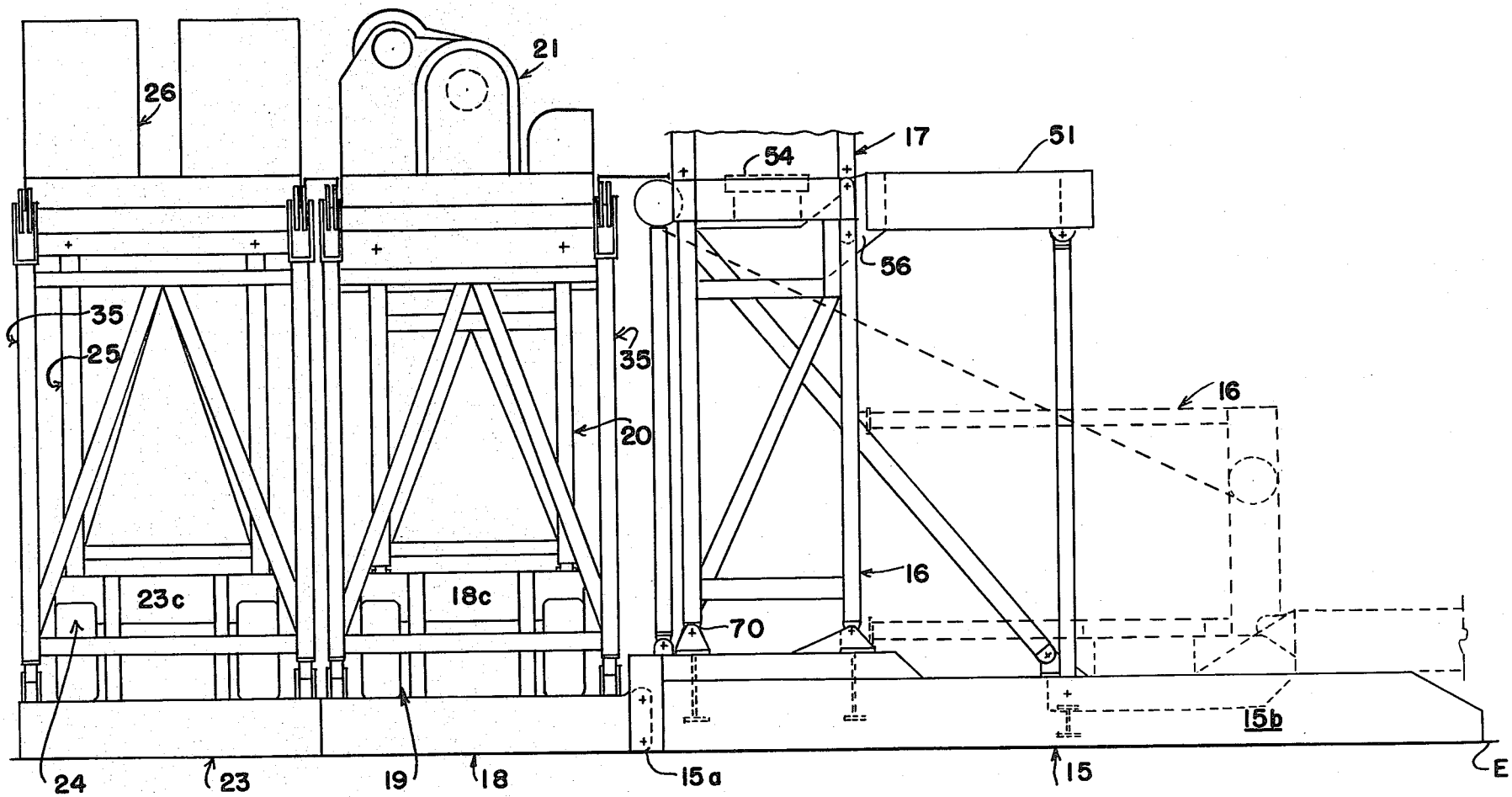
FIG. 8 illustrates the mast, setback tower and rotary table in final elevated position ready for drilling.

Attention is first directed to FIG. 8 of the drawings wherein base beam means 15 are provided for resting on the earth's surface represented by the letter E. Drilling mast support structure 16 is pivotally connected to the base beam means 15 so that it may be raised along with the mast represented at 17 thereon from an inclined position shown in dotted line to an erect position illustrated in full line in FIG. 8.

Drawworks trailer ramp means referred to at 18 are provided to receive the drawworks trailer means referred to generally at 19 which carries the drawworks support means represented at 20 and the drawworks means represented at 21 on the support means 20 thereon. Secured to and extending parallel to the drawworks trailer ramp means 18 is the power source trailer ramp means referred to generally at 23 which receives and supports the power source trailer means referred to generally at 24. The power source trailer means 24 has mounted thereon the power source support means referred to generally at 25 and the power source means referred to generally at 26 on the power source support means 25.

The drawworks trailer ramp means 18 and power source trailer ramp means 23 are secured adjacent one end 15*a* of the base beam means 15 and extend at substantially a right angle relative thereto as illustrated in the drawings.

When it is desired to disassemble the arrangement shown in FIG. 8 and move it to another location, the drilling mast 17, mast support 16 and related structure may be lowered, whereupon the mast may be sectionalized for transport as will be described.

The drawworks means 21 and support means 20 therefor may be lowered onto the trailer 19, and the power source 26 and the support means 25 may be lowered on the trailer 24 and the trailers moved off the ramps 18 and 23.

The ramps 18 and 23 may be disconnected from each other and from the base beam means 15 and the base beams separated and loaded on suitable trailer means (not shown) for transport. It is believed that the present invention will reduce by approximately one-half the number of trailer loads required to move a drilling mast and all the associated structure thereof from one location to another.

In addition, the arrangement of the components enables the structure to be disassembled for moving, and to then be reassembled at a new location with a minimum of effort.

Figure 1:
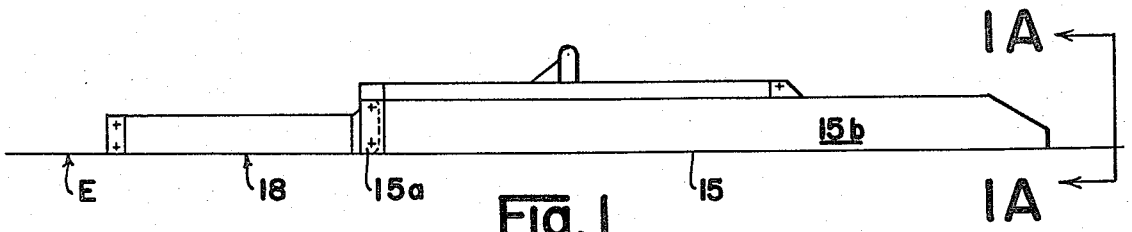
FIG. 1 is a side view showing base beam means to support the drilling rig positioned at a well location and showing in end view the drawworks trailer ramp means secured thereto substantially at a right angle.
Figure 1A:
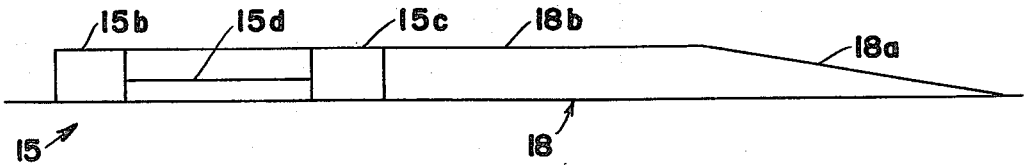
FIG. 1A is a view on the line 1A—1A of FIG. 1 illustrating the spaced arrangement of the base beam means.

Attention is directed to FIG. 1 of the drawings along with FIG. 1A where the base beam means 15 is illustrated as including two longitudinally extending structural members **15*b* and 15*c* which may be maintained in spaced relation as illustrated by any suitable brace means 15*d*** extending laterally therebetween.

It can be seen that the drawworks trailer ramp means 18 is secured adjacent the end **15*a* of the beams 15*b* and 15*c* by any suitable means and extends at a right angle relative to the ends 15*a* of each of the beams 15*b* and 15*c* as more clearly illustrated in FIG. 1A. The drawworks trailer ramp means 18 is provided with a sloping surface 18*a* at one end whereby the first trailer means generally represented at 19 may be backed up onto the surface 18*a* and onto the flat surface portion 18*b* as better illustrated in FIGS. 2 and 3** of the drawings.

Figure 4:
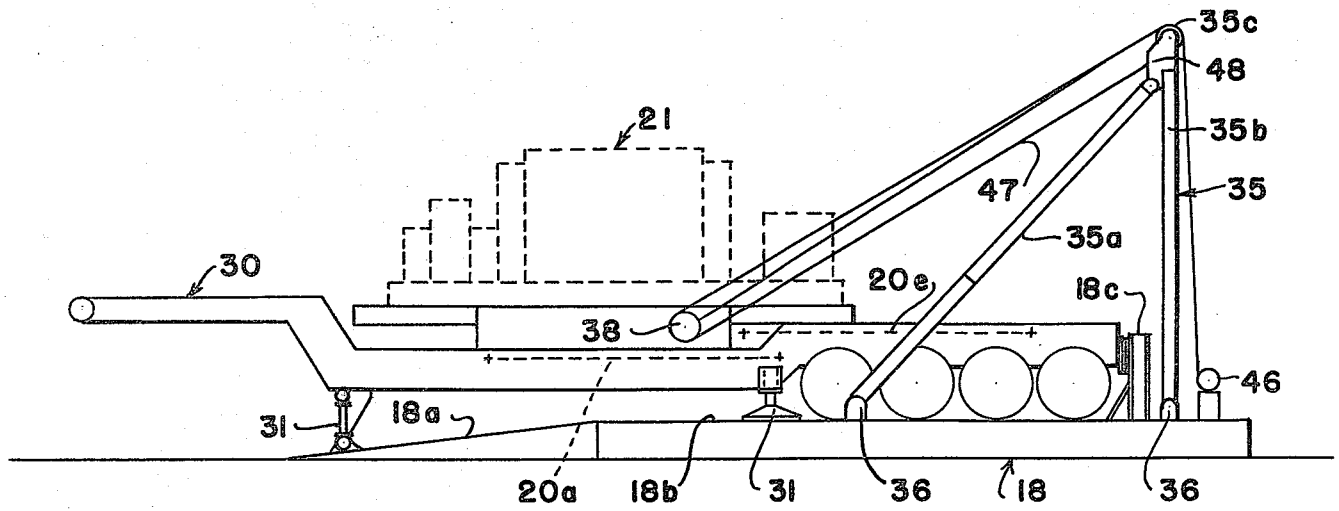
FIG. 4 illustrates the final position of the drawworks trailer means on the drawworks trailer ramp and the support therefor prior to elevating the drawworks.

When the first trailer means 19 is moved onto the drawworks trailer ramp means 18 and abutted against the stop structure **18*c* extending upwardly from the surface 18*b*, the support pads 31 on such trailer means 19 may be adjusted to engage the drawworks trailer ramp means and position the first trailer 19 thereon as more clearly illustrated in FIG. 4** of the drawings.

Figure 2:
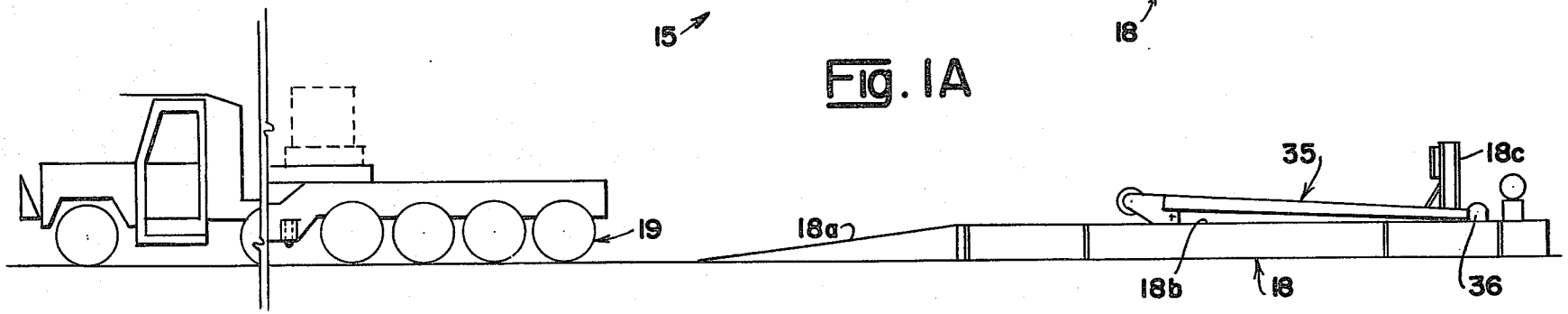
FIG. 2 is a side view of the drawworks trailer ramp means with A-frame means pivotally secured thereto and illustrating the first trailer means with the drawworks support means and drawworks on the support means being backing into position on the drawwork trailer ramp means.
Figure 3:
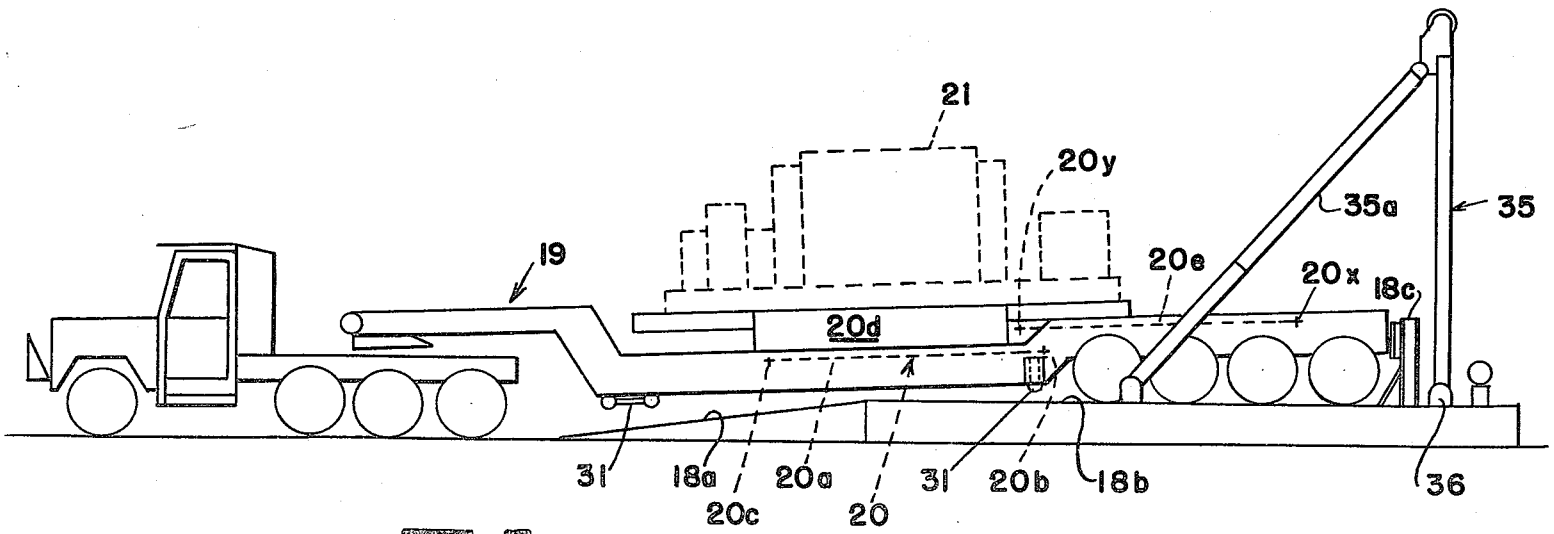
FIG. 3 illustrates diagrammatically the drawworks trailer means, with the support means pivotally secured thereto and drawworks means on the support means being positioned on the drawwork trailer ramp means and with the A-frame erected to enable the pivotally mounted drawwork support means and drawworks thereon to be elevated.

An A-frame structure represented by the numeral 35 is pivotally connected as illustrated at 36 so that it may be moved from the reclined position shown in FIG. 2 to the elevated position shown in the other drawings and retained there by means of the brace **35*a* which is connected at one end to the trailer ramp means 18 and at the other end of the upper end of the elevated A-frame means 35 as shown in FIGS. 3 and 4** of the drawings.

The drawworks support means 20 of FIG. 8 include members **20*a* shown in part in FIG. 3 in dotted line extending longitudinally adjacent each side of the first trailer means 19 and pivotally connected at one end 20*b* to the trailer means 19 and at their other end 20*c* to the upper part of the drawworks support means represented at 20*c*. A second pair of members 20*e* are connected at one end 20*x* to the trailer 19 and at the other end 20*y* to the upper part of drawworks support means 20*d* so that the drawworks 21 and support arrangement therefor may be elevated from the position on the trailer 19 as illustrated in FIG. 3 of the drawings to the position shown in FIG. 5 of the drawings. When the support means 20 is in this position, the pivotal connections 20*b*, 20*c*, 20*x* and 20*y* may be secured or locked by any suitable means to retain the support means 20 and drawworks 21** in such elevated position.

Figure 5:
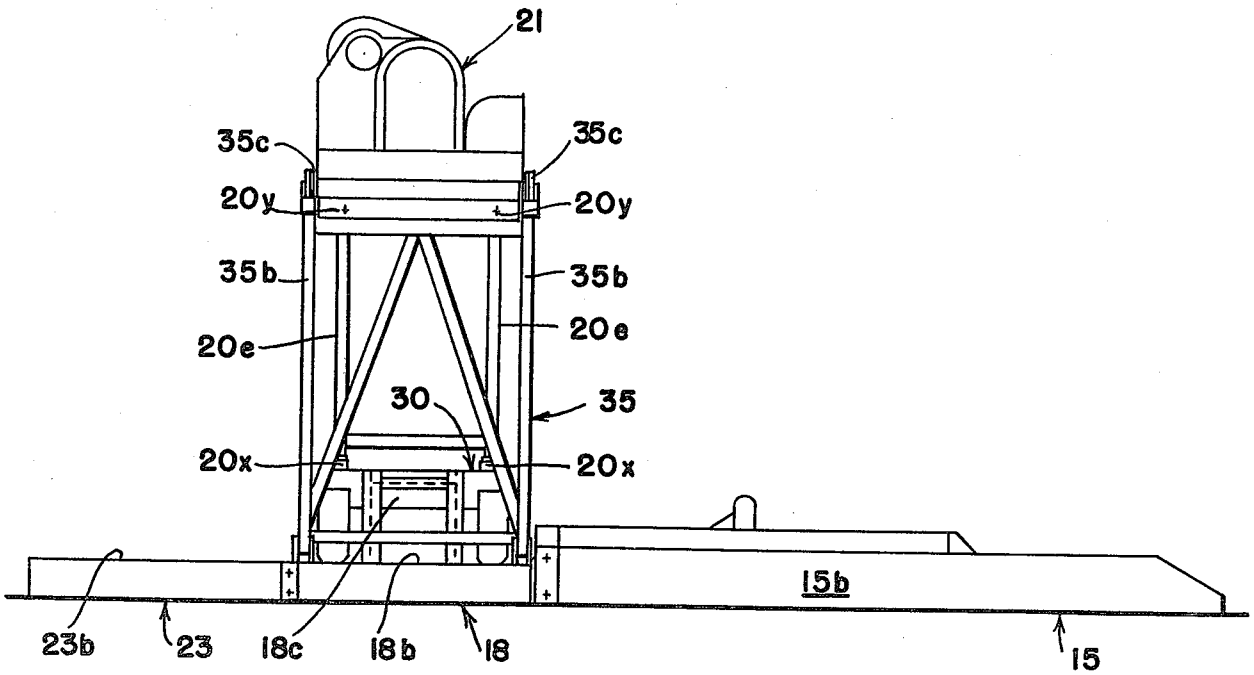
FIG. 5 illustrates in end view the drawworks support means and drawworks in elevated position.
Figure 6A:
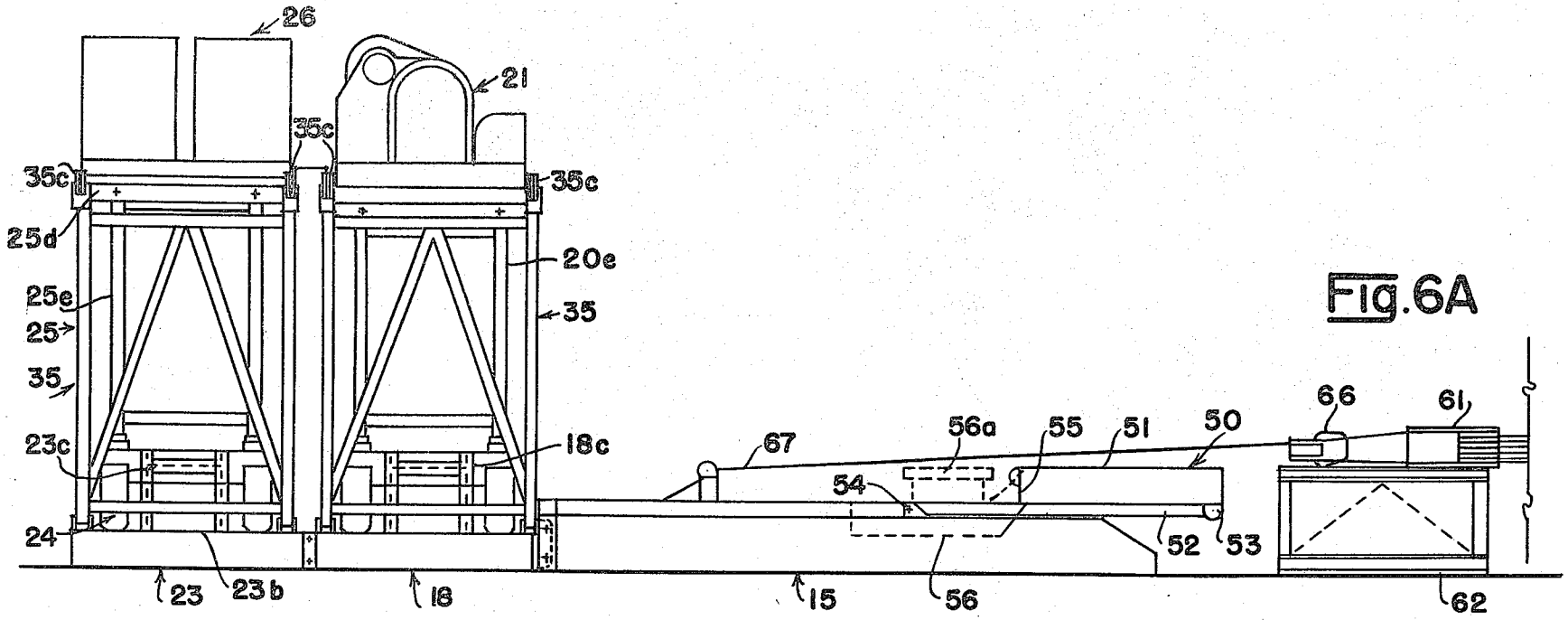
FIG. 6A shows both the drawworks trailer means and power source trailer means in position on the drawworks trailer ramp and power source trailer ramp respectively and secured together and secured to the ends of the base beam means with the drawworks means and power source means in elevated position. A setback tower is shown as being secured to and extending between the base beam means with rotary table means secured to the setback tower and extending longitudinally therefrom. The traveling block is shown supported on a separate structure spaced from the base beam means.

The second trailer means 24 is moved in a similar manner onto the power source trailer ramp means 23 until it contacts the stop means **23*c* as shown in FIG. 6A. The second trailer means 24 is of the same general configuration and arrangement as the first trailer means 19. Also, the power source trailer ramp means 23 is of the same general configuration as that shown for trailer ramp means 18 including an inclined surface which enables the second trailer means 24 to be moved up onto the flat surface means 23*b*. The second trailer means 24 also includes an A-frame 35 which is adapted to be moved from a reclined to an elevated position and retained therein in the position as described with regard to the A-frame 35 of the first trailer means 19. Similarly, the second trailer means 24 includes pivotally connected support means 25 comprising members similar in configuration and arrangement to members 20*a* and 20*e* of the first trailer means 30. As shown in FIG. 6A the means 25*e* of the support means correspond with the member 20*e* of the support means on the first trailer means 19 shown in FIG. 5. The members including the members 25*e* that are pivotally connected to the second trailer means 24 are also connected to the upper part 25*d* of the support means 25 for the power source means represented by the numeral 26 and provide an arrangement whereby the support means 25, along with the power source 26 may be elevated to and secured in an elevated position adjacent the drawworks means 21 as shown in FIG. 6A** of the drawings.

In order to accommodate the raising and the lowering of the drawworks means 21 and support arrangement therefor relative to the first trailer means 19 and in order to raise and lower the power source means 26 and the support means 25 therefor relative to the second trailer means 24 an arrangement as illustrated in FIGS. 4 and 5 is shown. Each member **35*b* of the A-frame generally referred to at 35 includes sheave means 35*c*** at the upper end thereof.

Similarly, sheave means 38 are mounted on each side of the support structure for the drawworks 21 and the power source 26, respectively with one sheave 38 being aligned with one of the sheaves **35*c* on each A-frame means 35**.

Winch means 46 are mounted on each trailer ramp means 18 and 23, and a cable 47 is connected at one end 48 adjacent the upper end of the A-frame means 35 and extends downwardly and underneath and around the sheave 38 and then over the sheave means **35*c* and the other end of cable 47 is wound on the drum of the winch 46. A similar cable is provided for each side of each of the A-frame means 35 and is connected to a winch aligned therewith and supported on each trailer ramp means 18 and 23**.

When power is supplied to the pair of winches on each of the trailer ramp means 18 and 23, the drawworks 21 and the power source means 26 are moved from the reclined position shown in FIG. 4 of the drawings to the elevated position shown in FIG. 5 and other of the drawings.

It can be appreciated that when it is desired to again lower the drawworks 21 and power source means 26 to enable the structure to be moved to another location, this operation may be reversed by first disconnecting the pin which locks the members **20*a* and 20*e* in position whereupon the winches 46 may be rotated to reel out the cable 47 and enable the support means and drawworks 21 as well as the support means and the power source means 26 thereon to be lowered onto their respective trailers. In the event, the winch means 46** becomes inoperative, the foregoing may be accomplished by using truck winch means.

A setback structure or tower as referred to generally by the numeral 50 is placed in position on beam means 15 by any suitable means such as a crane or the like, and the drilling mast sections connected together and to the base beam means hereinafter described. Thereafter the drawworks support means 20 and power source support means 25 may be elevated. More particularly, the setback structure 50 includes a platform 51 that extends laterally between the base beams 15*b* and 15*c*. Support legs 52 are pivoted at their upper end 53 to one end of the platform 51 and are pivotally connected at their lower end at 54 to the base beams 15*b* and 15*c* respectively.

Connected to the end 55 of the platform 51 are the rotary table support beams 56 which extend generally longitudinally of the platform 51 as shown in the drawings. The beams 56 receive and support the rotary table 56*a*. The members 56 are spaced and are of sufficient length to extend between and the width of the mast support structure 16 when the mast support structure and mast thereon are in elevated position.

The drilling mast top section 60, traveling block 61, the wire line or cable means extending therebetween and the cable means surplus storage spool are transported on suitable trailer means.

Thereafter, the drilling mast top section 60 is moved into position and the traveling block represented at 61 is lifted from the transport trailer and supported on a platform 62 in longitudinally spaced relation to the end of the setback tower 50 which projects beyond the ends of the base beams 15*b* and 15*c*.

The cable means represented at 64 remains connected between the crown block represented at 65 on the top mast section 60 and the traveling block 61 as shown. The hook 66 is connected to the traveling block 61 and a snub line 67 is connected between the hook 66 and the base beam means 15 so that as the tractor and mast top section 60 are moved to the right, the cable means 64 is extended between the crown block 65 and traveling block 61.

Figure 6B:
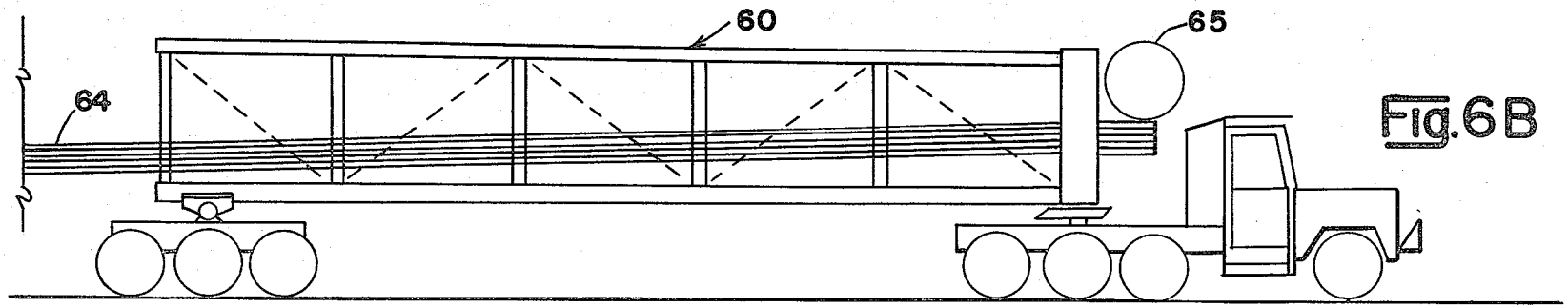
FIG. 6B illustrates the top section of the mast with the crown block thereon connected with the traveling block shown in FIG. 6A by cable means.

The tractor means illustrated in FIG. 6B is moved to the right a suitable longitudinal distance to enable the mast support structure 16 and lowermost mast section 60*a* to be positioned by suitable crane means or the like so that the lower end 16*a* of the mast support structure may be pivotally connected to the footing 16*b* on the base beams 15*b* and 15*c*. The lower mast section 60*a* is connected by any suitable means as illustrated at 68 to the end of the mast support structure 16.

The upper end of the lower mast section 60*a* is connected as illustrated at 69 to the middle mast section represented at 60*b*, which middle mast section may be positioned by any suitable means such as a crane or the like. Thereafter the trailer carrying the upper mast section 60 can be backed up to enable the upper mast section 60 to be secured to the end of the middle mast section 60*b* by any suitable means as represented at 71.

The setback tower 50 is pivotally connected adjacent the end 55 thereof to the mast support 16 as represented at 55*a*. By reason of the pivotal connection 55*a*, the setback tower 50 and the rotary table 56*a* secured therewith will move with the mast support 16 and drilling mast mounted thereon as it is elevated until the setback tower 50 assumes the position as illustrated in solid line in FIG. 8 with the rotary table 56*a* and its support means 56 extending between the laterally spaced portions of the mast support sections 16 so that they may be secured therewith. Also, such movement properly positions the rotary table 56*a* as shown to accomplish desired drilling operations.

After the mast support 16 and drilling mast secured therewith have been elevated, the lower end of the mast support 16 may be secured by any suitable means such as illustrated at 70 to retain it in elevated position during drilling operations.

Figure 7A:
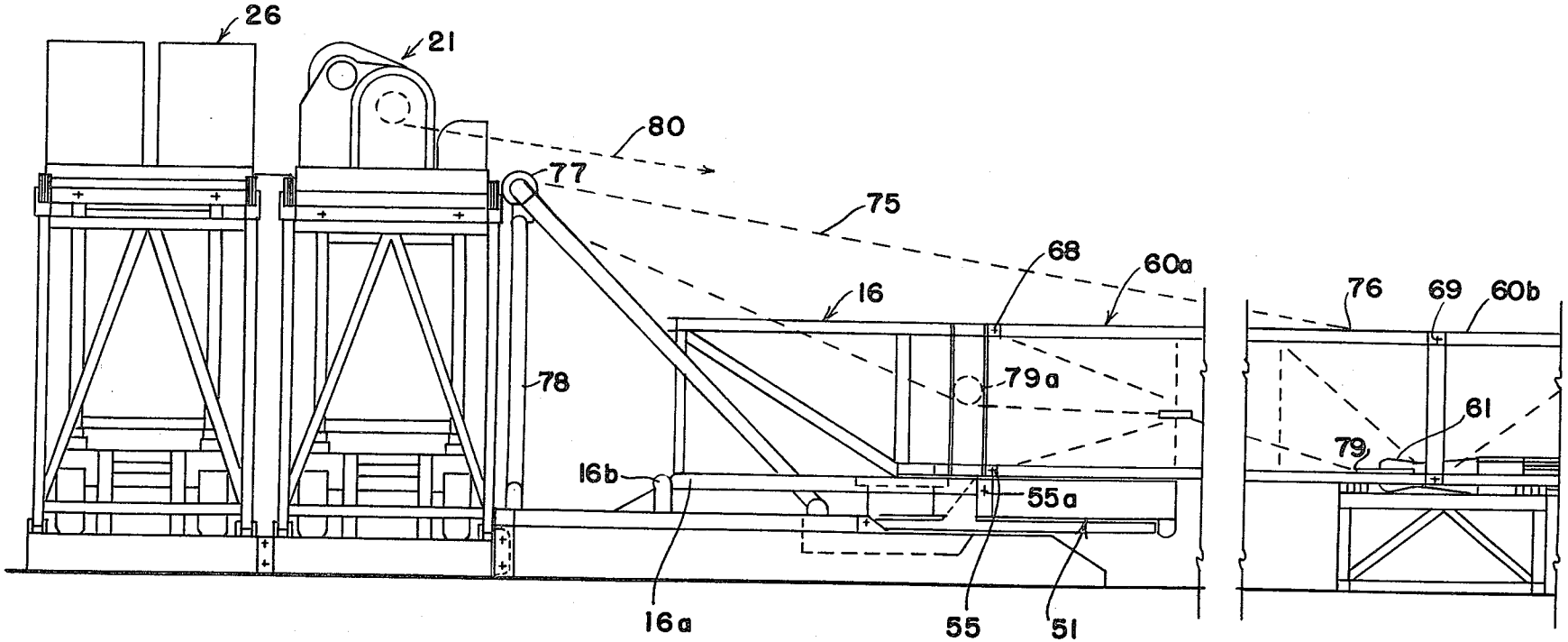
FIG. 7A illustrates the arrangement when mast A-frame means are in elevated position on the base beam means, with the the mast support means pivotally secured to the base beam means and extending longitudinally of the base beam means to be supported at its other end on the support means on which the travelling block is temporarily positioned.
Figure 7B:
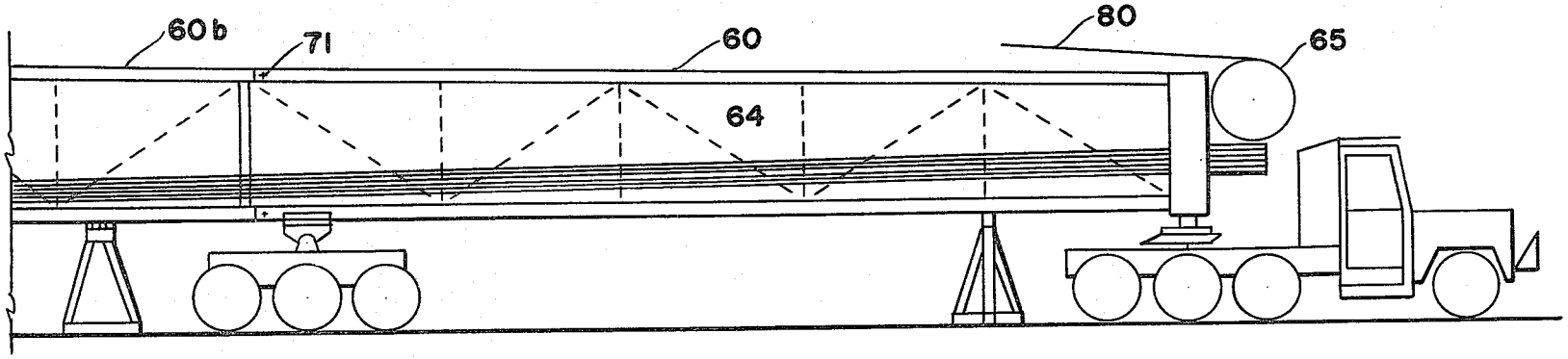
FIG. 7B is a continuation of FIG. 7A and shows the upper end of the middle mast section secured to the lower end of the top mast section and with the top mast section, truck and trailer moved to enable the lower and middle sections of the mast to be positioned and then the top mast section secured to the end of the middle mast section.

In order to elevate the reclined mast and mast support structure as well as the setback tower 51 and rotary table 54, suitable cable means as illustrated in FIGS. 7A and 7B may be employed. The mast A-frame means 78 is mounted on base beam means 15 and includes portions which are aligned with each side or edge 76 of the mast support 16 to support sheave means 77 for assisting in elevating and lowering the mast support and mast carried thereon. A sling line 75 is connected at one end to one of the edges or sides 76 of the reclined mast. The sling line then extends over a sheave 77 on the erect A-frame means 78 aligned with that side of the mast, extends under sheave means 79*a* in the mast, extends over the hook 79 connected to the traveling block 61, extends under another sheave 79*a* in the mast, over a sheave 77 on the A-frame means 78 aligned with that side of the mast and is then connected at its other end to the other side 76 of the reclined mast. The line 80 extends from the crown block 65 and is connected with the drum of the drawworks 21. Thus, when the drum of the drawworks is rotated so as to tighten the cable 80, the force is exerted through the cable means 64 extending between the crown block 65 and the travelling block 61. However, the travelling block is retained in position by means of the sling line 75 illustrated in FIG. 7A, so that the reaction causes the drilling mast support 16 and connected drilling mast sections to move to an elevated position adjacent the A-frame means 78 to thereafter enable the mast support lower end to be connected to the base beams 15 as illustrated at 70 as previously mentioned.

When it is desired to move the drilling mast and associated structure to another location, the foregoing described procedure may be reversed and the drilling mast sections positioned on trailer means. The drawworks 21 and power source means 26 are each lowered on the trailer and they along with the trailer ramp means 18 and 23 and the base beams means 15*b* and 15*c* are placed on trailer means and transported to a new location.

This arrangement enables a drilling mast of substantially greater capacity than heretofore possible to be moved along public roads with a minimum of regulation and with a minimum number of loads. Also, the arrangement greatly expedites not only rig-up time at a new location, but also expedites rig-down time and transport to another location.

The foregoing disclosure and description of the invention are illustrative and explanatory thereof, and various changes in the size, shape, and materials as well as in the details of the illustrated construction may be made without departing from the spirit of the invention.

What is claimed is:

1. A sectionalized drilling mast, power arrangement and support means therefor which may be readily assembled at a well location and disassembled into sections for trailerized transport comprising:

a. base beam means to support the drilling mast when in reclined position and when it is in upright position;

b. drawworks trailer ramp means secured at substantially a right angle to said base beam means;

c. power source trailer ramp means secured to said drawworks trailer ramp means and extending parallel thereto;

d. A-frame means connected to and extending upwardly from each said drawworks trailer ramp means and said power source trailer means respectively;

e. first trailer means on said drawworks trailer ramp means;

f. drawworks support means pivotally connected to said first trailer means with drawworks means supported thereon;

g. second trailer means on said power source trailer ramp means;

h. power source support means pivotally connected to said first trailer means with power source means supported thereon;

i. drilling mast support means pivotally connected to base beam means and extending therealong in spaced relation when in reclined position;

j. setback tower means pivotally connected at one end to said mast support means and at the other end to said base beam means;

k. rotary table means connected to said setback tower means and extending parallel thereto when said drilling mast is in reclined position;

l. said setback tower means extending between said drilling mast means and said base beam means when said mast is reclined; and m. means to elevate;

1. said drawworks support means and drawworks thereon;

2. said power source support means and power means thereon; and 3. the drilling mast from a reclined to an upright position on said base beam means whereupon said setback tower means and said rotary table means are simultaneously elevated and swung into position relative to the upright drilling mast.

2. The invention of claim 1 wherein said means to elevate said drawworks support means includes:

a. spaced sheave means on the upper end of said A-frame means on said drawworks trailer ramp means;

b. spaced sheave means on said drawworks support means;

c. rotatable winch means;

d. means to rotate said winch means; and e. cable means connected at one end to said A-frame means and extending under said sheave means on drawworks support means and over said sheave means on said A-frame means and connected at its other end to said winch means whereupon rotation of said winch means elevates said drawworks support means and drawworks supported thereon.

3. The invention of claim 1 wherein said means to elevate said power source support means includes:

a. spaced sheave means on the upper end of said A-frame means on said power source trailer ramp means;

b. spaced sheave means on said power source support means;

c. rotatable winch means;

d. means to rotate said winch means; and e. cable means connected at one end to said A-frame means and extending under said sheave means on power source support means and over said sheave means on said A-frame means and connected at its other end to said winch means whereupon rotation of said winch means elevates said power source support means and power source supported thereon.

4. The invention of claim 1 wherein said means to elevate the drilling mast includes:

a. spaced sheave means on the upper end of said mast A-frame means;

b. spaced sheave means carried by said mast support means;

c. crown block means on said mast means;

d. traveling block means in said mast means with hook means thereon;

e. cable means connecting between said drawworks, crown block means and traveling block means; and f. sling line means connected at each end to said mast means and extending under said mast sheave means with said hook on said traveling block engaging said sling line means between the ends thereof whereby reeling in of said cable means on said drawworks causes said mast to elevate.

* * * * *